US006640983B2

(12) United States Patent
Miller, Jr.

(10) Patent No.: US 6,640,983 B2
(45) Date of Patent: Nov. 4, 2003

(54) SUSPENSION TYPE PRODUCT MERCHANDISING DISPLAY UNIT

(75) Inventor: Donald J. Miller, Jr., Belleville, IL (US)

(73) Assignee: Paul Flum Ideas, Inc., St. Louis, MO (US)

( * ) Notice: Subject to any disclaimer, the term of this patent is extended or adjusted under 35 U.S.C. 154(b) by 0 days.

(21) Appl. No.: 10/022,986

(22) Filed: Dec. 17, 2001

(65) Prior Publication Data

US 2002/0185461 A1 Dec. 12, 2002

Related U.S. Application Data

(63) Continuation-in-part of application No. 29/142,992, filed on Jun. 6, 2001, now Pat. No. Des. 455,295.

(51) Int. Cl.[7] ..... A47G 29/00

(52) U.S. Cl. ..... 211/85.29; 211/75; 211/89.01; 211/189

(58) Field of Search ..... 211/74, 75, 85.29, 211/59.1, 59.2, 87.01, 89.01, 66, 90.03, 106, 134, 189, 181.1, 103; 248/309.1, 311.2, 312, 312.1, 317, 339, 220.41, 124.1; D6/409–415, 458, 462–468, 475, 553, 566, 567, 572, 574; 40/642.01, 642.02, 658, 661.03

(56) References Cited

U.S. PATENT DOCUMENTS

| | | | | | |
|---|---|---|---|---|---|
| 3,243,220 | A | | 3/1966 | Karas | |
| 3,486,632 | A | * | 12/1969 | Balch | 248/221.11 |
| 4,318,485 | A | | 3/1982 | Clement | |
| 4,591,057 | A | * | 5/1986 | Garfinkle | 211/59.1 |
| 4,771,898 | A | * | 9/1988 | Howard et al. | 211/59.2 |
| 4,798,013 | A | * | 1/1989 | Sainato | 40/651 |
| 4,850,557 | A | * | 7/1989 | Valiulis | 211/59.1 |
| 5,205,421 | A | | 4/1993 | Bustos | |
| 5,305,898 | A | * | 4/1994 | Merl | 211/87.01 |
| 5,509,541 | A | * | 4/1996 | Merl | 211/103 |
| 5,641,081 | A | * | 6/1997 | Merl | 211/103 |
| 5,695,075 | A | | 12/1997 | Flum et al. | |
| 5,706,956 | A | | 1/1998 | Headrick et al. | |
| 5,769,247 | A | * | 6/1998 | Merl | 211/103 |
| 5,785,189 | A | * | 7/1998 | Gollob et al. | 211/187 |
| 5,836,460 | A | * | 11/1998 | Brown et al. | 211/74 |
| 5,865,326 | A | * | 2/1999 | Spamer et al. | 211/181.1 |
| 5,921,412 | A | * | 7/1999 | Merl | 211/90.03 |
| 6,003,685 | A | * | 12/1999 | Malin | 211/7 |
| D427,824 | S | * | 7/2000 | Osburn et al. | D6/511 |
| 6,119,990 | A | * | 9/2000 | Kump et al. | 40/642.02 |
| 6,279,761 | B1 | * | 8/2001 | Niewiadomski et al. | 211/94.01 |
| D455,295 | S | * | 4/2002 | Miller | D6/462 |
| D457,014 | S | * | 5/2002 | Miller | D6/462 |
| 6,389,722 | B1 | * | 5/2002 | Josefsson et al. | 40/642.01 |
| 6,394,288 | B1 | * | 5/2002 | Hartwall | 211/74 |

* cited by examiner

*Primary Examiner*—Daniel P. Stodola
*Assistant Examiner*—Jennifer E. Novosad
(74) *Attorney, Agent, or Firm*—Blackwell Sanders Peper Martin LLP

(57) ABSTRACT

A suspension rack for merchandising a plurality of product containers in parallel rows adaptable for mounting to a support structure including a plurality of tracks each having opposed front and rear end portions for supporting therein in single file a plurality of product containers, each track including a pair of elongated wire elements spaced apart to receive therebetween the upper portion of suitably sized product containers such that at least a portion of the upper portion of each product container engages at least a portion of the pair of wire elements forming each track whereby the product containers are suspended by their upper portions for movement relative to the wire elements, and a mounting structure associated with the rear portion of the suspension rack, the mounting structure including at least a pair of hook members for attaching to the support structure in a cantilever fashion. In one embodiment, the pair of wire elements forming each track are appropriately shaped and dimensioned to both provide a stop mechanism for holding such product containers within each track and to provide sufficient spacing for allowing each product container to be removed therefrom. In another embodiment, the wire elements forming each track allow for removal of the product containers from the front of each track only but provide no stop mechanism. An informational tag rail may likewise be provided for removably mounting pricing information or other indicia to the front portion of the suspension rack.

15 Claims, 8 Drawing Sheets

SUSPENSION TYPE PRODUCT MERCHANDISING DISPLAY UNIT

CROSS REFERENCE TO RELATED APPLICATION

This application is a continuation-in-part of design patent application Ser. No. 29/142,992, filed Jun. 6, 2001, now U.S. Pat. No. D455,275.

TECHNICAL FIELD

The present invention relates generally to product merchandising and display devices and, more particularly, to several embodiments of a merchandising unit adaptable for use with a support structure wherein a plurality of product containers are suspended in one or more adjacent rows from tracks or rails for slidable movement therealong towards a front portion of the unit for easy access and removal therefrom. The present suspension type unit includes an attachment mechanism for removably and adjustably mounting any number of a plurality of product holding racks to a support structure at various elevations therealong so as to more prominently display the lead product container in each product track for better visibility and customer recognition.

BACKGROUND OF INVENTION

Suspension type devices for displaying and merchandising a wide variety of different types of soft drink and fruit juice products in supermarkets, convenience stores, and other retail outlets have gained considerable popularity among retailers and other merchandisers due to the fact that such devices are extremely effective in presenting substantially the entire product container for full view and easy access by consumers. Changes in consumer taste have caused an evolution towards taller product containers, especially taller soft drink and fruit juice containers, which taller containers tend to be more top heavy and more unstable when supported on a conventional product merchandising unit wherein the product containers rest upon a supporting floor surface. Suspension type devices have substantially eliminated the previous problems associated with conventional display units wherein such taller containers have a greater tendency to tip and fall over the shorter divider walls associated with such known product merchandising units into adjacent product channels thereby substantially hindering and disrupting the operation of such prior art devices. Product visibility and access to such products are increasingly important in today's highly competitive retail soft drink market as soft drinks and fruit juices are often selected and purchased by impulse at point-of-sale and other locations throughout a retail outlet. Anything that detracts from a product's attractiveness, visibility, or accessibility such as an obstructive or difficult to use display device will tend to cause customers to select a better displayed product. Suspension type devices present the product to consumers in an effective and attractive manner and such devices are easy to use and service by store personnel.

In the case of suspension type gravity feed merchandising display units, the products displayed on such units are successively advanced automatically towards the lower or forward end portion of the device as a forward most product container is removed by a consumer. Such gravity feed devices again provide better product visibility and accessibility and require less attention and maintenance since such devices display the product container attractively and in full view at the end of each product track.

There are many known suspension type devices in the art. One example of such a suspension type device is disclosed in U.S. Pat. No. 5,695,075, which patent is owned by Applicant's assignee. Display units utilizing suspension type devices typically comprise a support structure which has mounted thereon a plurality of merchandising suspension devices. Oftentimes, in a retail outlet, the support structure pre-exists such as the elongated support members associated with many cooler type display units commonly used in convenience stores and the like. These pre-existing support structures limit the ability of many devices to be used in association with such support structures due to dimensional variations thereby requiring the device to be custom manufactured with attendant inventory problems. Further, oftentimes, because of the weight that such devices must support, such devices must be strong yet light in weight in order to facilitate their easy use by store personnel. Another problem associated with many of the available suspension type merchandising display devices is that they require special tooling to manufacture. For example, some are made of molded plastic requiring expensive molds to be made in order to manufacture the various component parts. Further, in the case of molded units, they typically cannot be easily repaired. Still further, some devices are difficult to clean because of their overall construction and because they utilize large exposed surface areas. Thus, there is a need for an improved suspension type product merchandising display unit.

Accordingly, the present invention is directed to overcoming one or more of the problems as set forth above.

SUMMARY OF INVENTION

The present invention overcomes many of the shortcomings and limitations associated with the known suspension type devices and teaches the construction and operation of several embodiments of a suspension type merchandising display unit which includes a support structure having a plurality of attachment elements associated therewith for engaging and holding any plurality of suspension racks each adaptable for holding and displaying product containers. The suspension racks are carried by the support structure and are attached to the support structure by a plurality of the attachment members which are cooperatively engaged with the attachment elements associated with the support structure. Each suspension rack further includes a plurality of tracks each having a dispensing end positioned in spaced relation across a front face of the rack. The tracks may be level or inclined for gravity feed of the product containers. The tracks are adapted to receive therein product containers for releasable and slidable retention and movement therealong. At least some of the tracks are formed by a pair of spaced apart rigid wire or rod members adapted to engage an upper portion of a product container for storage therebetween in a suspended condition. The product containers are stored in a plurality of adjacent single file rows and stop means may be provided to prevent accidental discharge of the containers from a track.

The present invention also includes an informational tag rail or price rail adapted for releasable mounting onto merchandising display racks for the display of such information as advertising and product pricing. The tag rail includes an elongated panel member having front and rear surfaces. A pair of slots associated with the front face of the panel member are spaced apart from one another and open generally toward one another. The slots extend in a direction generally between the opposite ends of the panel member and are adapted for receiving and releasably retraining informational strip members. The tag rail further includes a plurality of clip members extending from a rear surface of the panel member which are positioned at various locations along the length thereof. Each clip member has a pair of resiliently deformable opposite end portions having a space therebetween, this space being less than the transverse dimension of the rod member onto which the tag rail is to be mounted for releasably retaining the tag rail onto the display rack.

The present suspension type product merchandising display racks provide greater flexibility and are more easily positionable and adjustable vertically on the support structure so as to more readily and easily accommodate product containers of varying size and shape. The present suspension racks likewise more prominently display and present the lead bottle or lead product container in each product track for easy and convenient removal.

These and other aspects and advantages of the present invention will become apparent to those skilled in the art after considering the following detailed specification in conjunction with the accompanying drawings.

DETAILED DESCRIPTION

Figure 1:
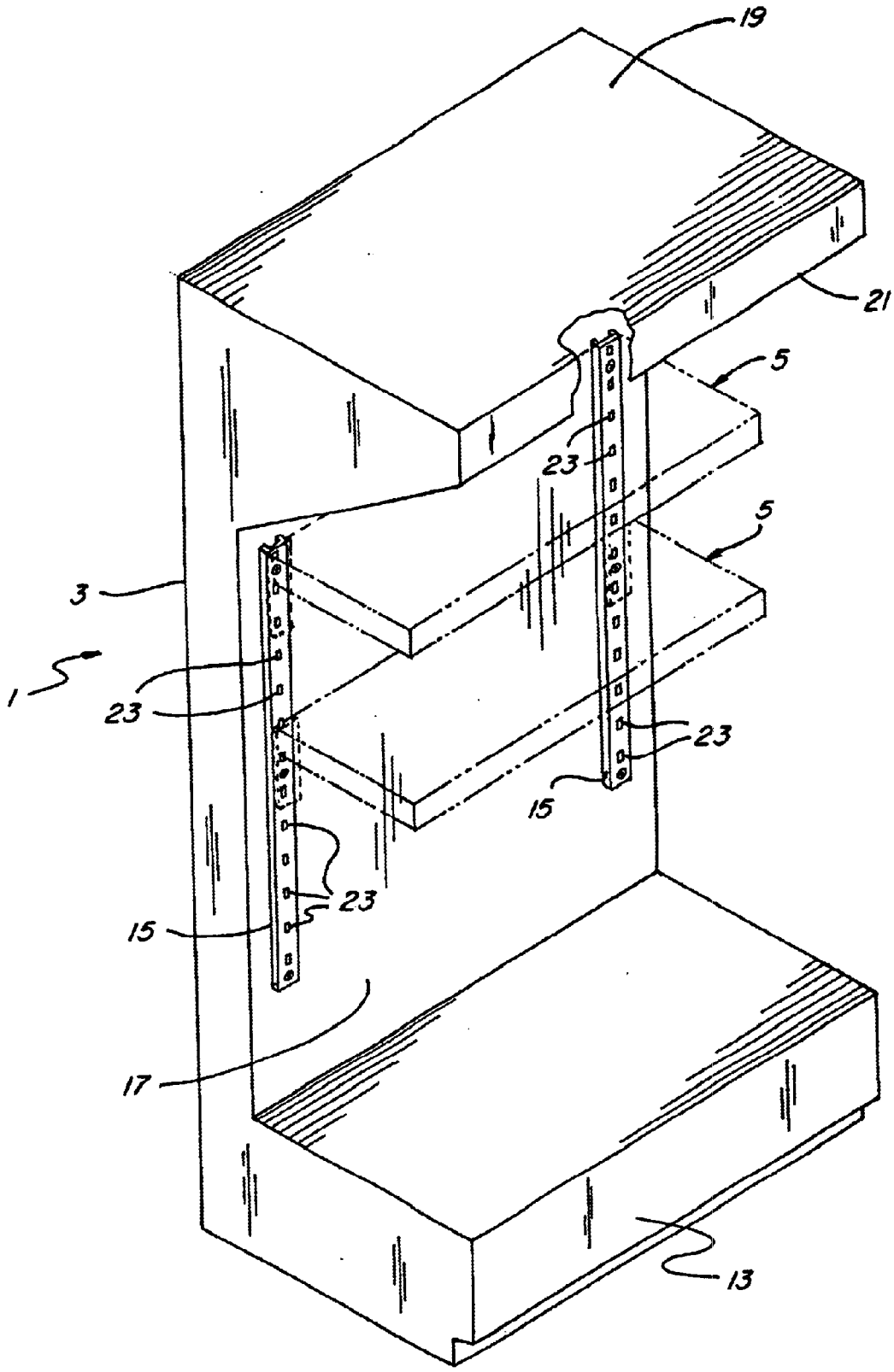
FIG. 1 is a perspective view of a suspension type product merchandising display unit constructed according to the teachings of the present invention, the present unit including one embodiment of a support structure and a plurality of suspension type racks engagable therewith.

Referring to the drawings more particularly by reference numbers wherein like numerals refer to like parts, number 1 in FIG. 1 identifies one embodiment of a suspension type product merchandising display unit constructed according to the teachings of the present invention, the display unit 1 including a support structure designated generally 3 and a plurality of suspension racks 5 carried by the support structure 3. One embodiment of the suspension racks 5 are illustrated in FIGS. 2–6 and an alternative embodiment is illustrated in FIGS. 7–11. The suspension racks 5 are preferably mounted on the support structure 3 for adjustability in the vertical direction as will be hereinafter further explained and are mounted in a cantilever fashion from the rear of each rack 5. The suspension racks 5 provide a plurality of adjacent product suspension tracks 7 each adaptable for carrying products such as the product container 9 (FIG. 2) adjacent an upper portion 11 of each product container 9 thereby suspending the product container for full display and easy removal by a consumer. As will be hereinafter further explained, each track 7 includes a pair of elongated wire elements or rail members 27 adapted to receive and support for slidable movement therealong in a single row the upper portions 11 of a plurality of product containers 9.

The support structure 3 includes a base 13 which is adapted to rest on a floor or other supporting surface associated with a particular merchandising location. The base 13 may take on a wide variety of different shapes or applications and may be in the form of many of the known load carrying rack assemblies including refrigerated display coolers, visi-coolers and other types of cold vaults used for displaying products, or it may be a freestanding unit for movement to various locations throughout the store. The support structure 3, as illustrated, includes a pair of generally vertical posts or support members 15 typical of the type of vertical support means used in the known load carrying product merchandising units including refrigerated display coolers, visi-coolers and other types of cold vaults. The posts 15 may be secured to a backing panel 17 for additional rigidity and load carrying capacity. An overhead canopy 19 may also be provided. The canopy 19 may be used to conceal lighting to provide a front face 21 for advertising or other product indicia, to direct air flow, or for other uses such as to prevent contaminating materials from falling onto the displayed products as is well known in the art.

As illustrated in FIG. 1, each post or support member 15 includes attachment means which cooperate with the suspension racks 5 for the removable mounting of each rack 5 onto a pair of support members 15. In one embodiment, the attachment means may include a plurality of spaced hooks, a plurality of spaced openings, or other similar attachment means formed through one or more surfaces of the support members 15 at spaced intervals along the length thereof such as the vertical spaced slots or openings 23 illustrated in FIG. 1. The slots or openings 23 are generally rectangular in shape and are dimensioned so as to cooperatively engage corresponding hook members 25 which are provided as the attachment members on each of the suspension racks 5 as will be described in more detail below. The upright support members 15 may likewise be of conventional construction which are typical of the type of vertical support means utilized in many of the known load carrying rack assemblies including refrigerated display coolers, visi-coolers and other types of cold vaults used for displaying and merchandising products in locations such as convenience stores, mini-marts, supermarkets, grocery stores and the like. In this situation, each upstanding support member 15 may be of a rectangular, tubular construction and may include a plurality of spaced hook members, openings or other similar attachment means formed through one or more side surfaces of such support members at spaced intervals along the length thereof. The suspension racks 5 can be attached in supportive relationship to the conventional upstanding support members utilized in many of the known load carrying rack assemblies including refrigerated display coolers, visi-coolers and other types of cold vaults by using a wide variety of conventional means such as the hook members 25 associated with the rear portion of the suspension rack 5, each hook member 25 having one end portion thereof insertable into a corresponding slot or opening 23 associated with the upright support members 15. It is also recognized and anticipated that the support members or posts 15 may include the hook members 25 and the suspension racks 5 may include the corresponding slots or openings 23.

Figure 2:
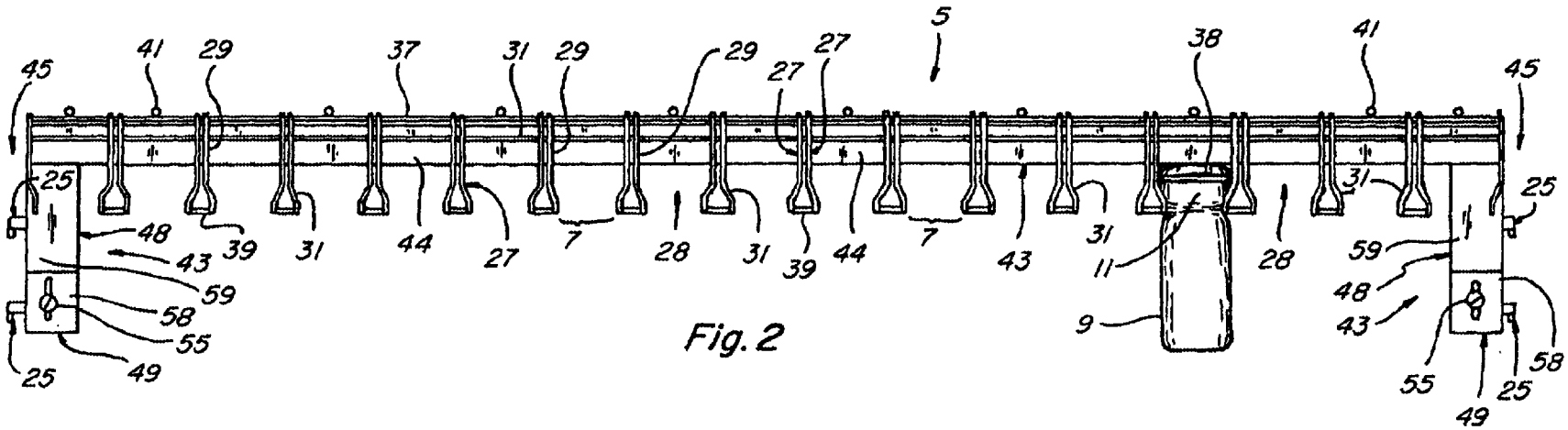
FIG. 2 is a front elevational view of one embodiment of the suspension type product merchandising display rack of FIG. 1.
Figure 3:
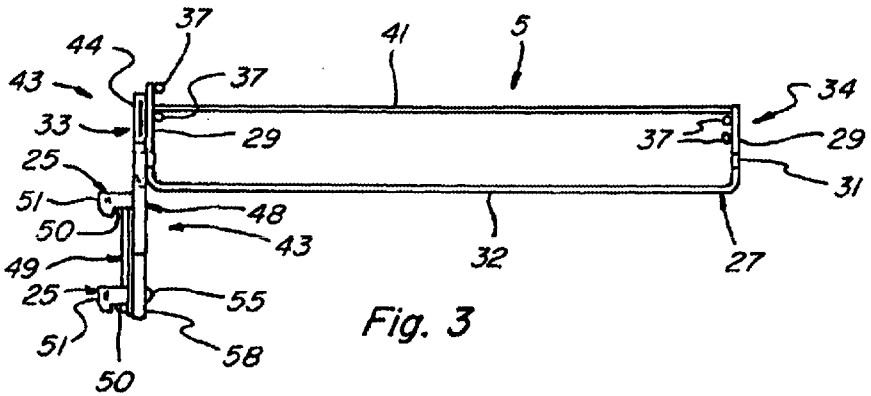
FIG. 3 is a side elevational view of the suspension rack of FIG. 2.

The suspension rack 5 as illustrated in FIGS. 2–6 represents one embodiment of the present suspension rack and is of an open wire grid construction having a plurality of adjacent tracks 7 formed therein, each track 7 being formed by a pair of elongated wire elements 27 preferably having a generally round transverse cross-section. Each wire element 27 may be either solid or tubular in construction depending upon the strength needed to carry the particular products to be displayed and suspended therefrom. Each wire element 27 associated with a particular track 7 includes a substantially straight upstanding wire portion 29 located at each opposite end thereof, a downwardly and inwardly sloped portion 31 integrally formed with or other attached to each wire portion 29, and a substantially straight wire portion 32 extending between and again preferably integrally formed with or otherwise connected to the inwardly sloped wire portions 31 as best seen in FIGS. 2 and 3. The spacing between adjacent wire portions 29 and 31 forming a respective track 7 likewise forms an opening or mouth 28 for the insertion and removal of the product containers 9. As best illustrated in FIG. 2, the opening or mouth 28 extending between each respective pair of upstanding wire portions 29 forming a particular track 7 is larger than the spacing between the respective downwardly and inwardly sloped wire portions 31 thereby narrowing the opening or mouth 28 so as to provide a stop or holding mechanism at the front portion of each track 7 which engages the lead product container 9 adjacent its upper portions 11. As a result, the substantially straight and parallel wire portions 32 associated with each track 7 are spaced sufficiently close together such that at least a portion of the upper portion 11 or neck portion of each product container 9 will engage and rest upon the wire portions 32 for supporting the product containers 9 for slidable movement therealong. In this regard, the wire portions 32 of each track 7 are spaced sufficiently far apart to allow for the relatively free passage of the neck portion of each product container therebetween.

The actual fit between each product container 9 and each track 7 can be anything from a loose fit, but not sufficiently loose so as to allow the product containers to fall between the wire portions 32, to a tight fit or a frictional fit to help prevent accidental discharge or loss of the product containers from each respective track 7. Generally, the fit between the product container 9 and the track 7 is such that if the substantially straight and parallel wire portions 32 are inclined downwardly from the back 33 of the rack 5 to the front 34 of the rack 5, a gravity feed operation may be accomplished. The substantially straight and parallel wire portions 32 forming each respective track 7, as just described, in use, may be sloped downwardly from back to front in order to achieve a gravity feed operation, or wire portions 32 may be positioned in a generally horizontal orientation if a gravity feed operation is not desired. Also, the slope of the tracks 7 may even be downwardly towards the rear of the rack 5 so as to ensure that the product containers 9 will remain engaged with each respective track 7, or the initial slope of each respective track 7 may be towards the rear of the rack in a no load condition such that under the load of the product containers 9 positioned within each respective track, the slope of the tracks 7 will change to either a level orientation or a downwardly sloping gravity feed operation. Still further, and importantly, both the front and rear portions of each respective track 7 may be formed as described above with an opening or mouth 28 associated with each respective end of each track 7. This allows the rack 5 to be loaded with product from either the front or back portion of the rack as will be hereinafter further explained.

Figure 4:
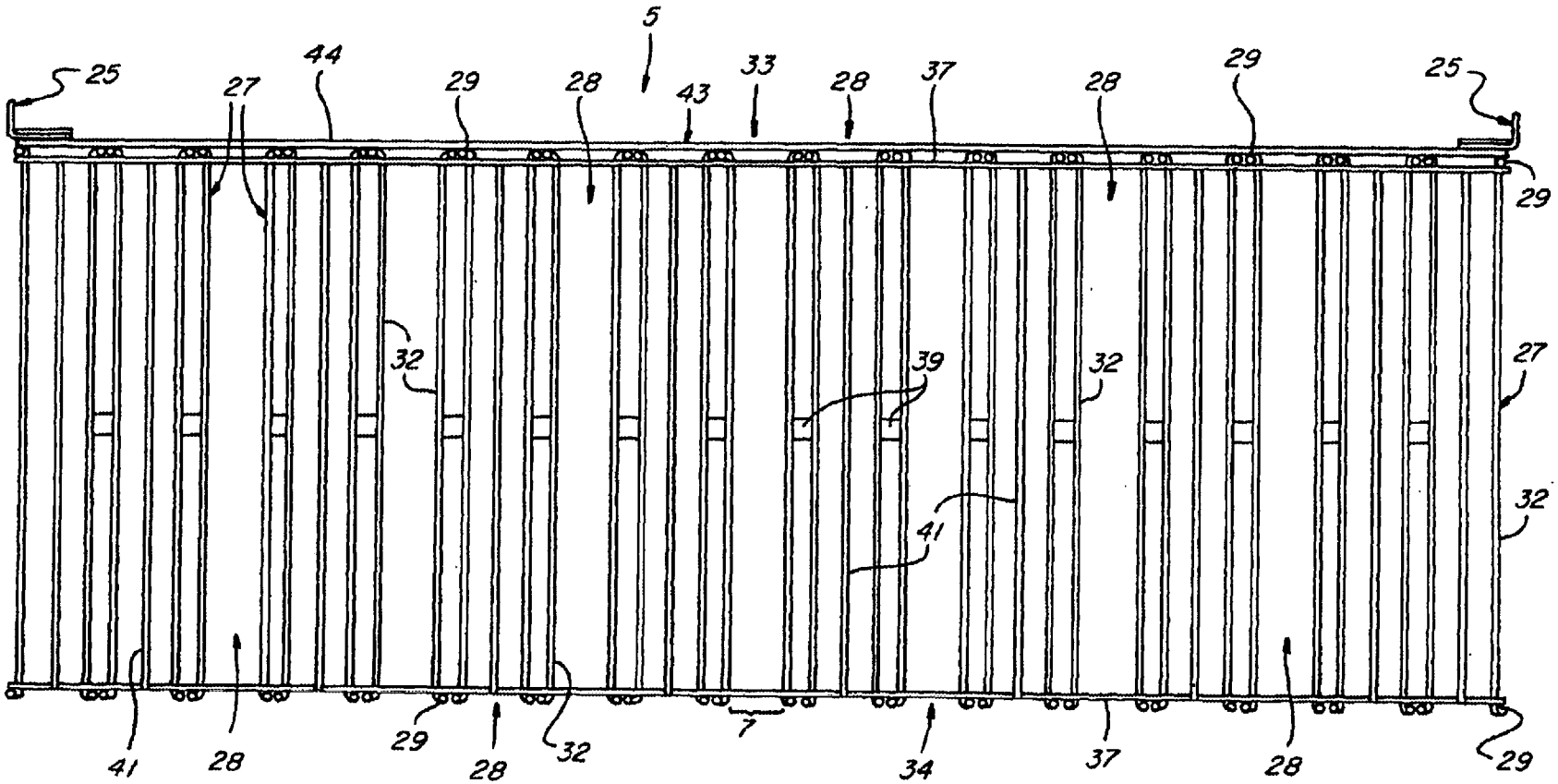
FIG. 4 is a top plan view of the suspension rack of FIG. 2.
Figure 5:
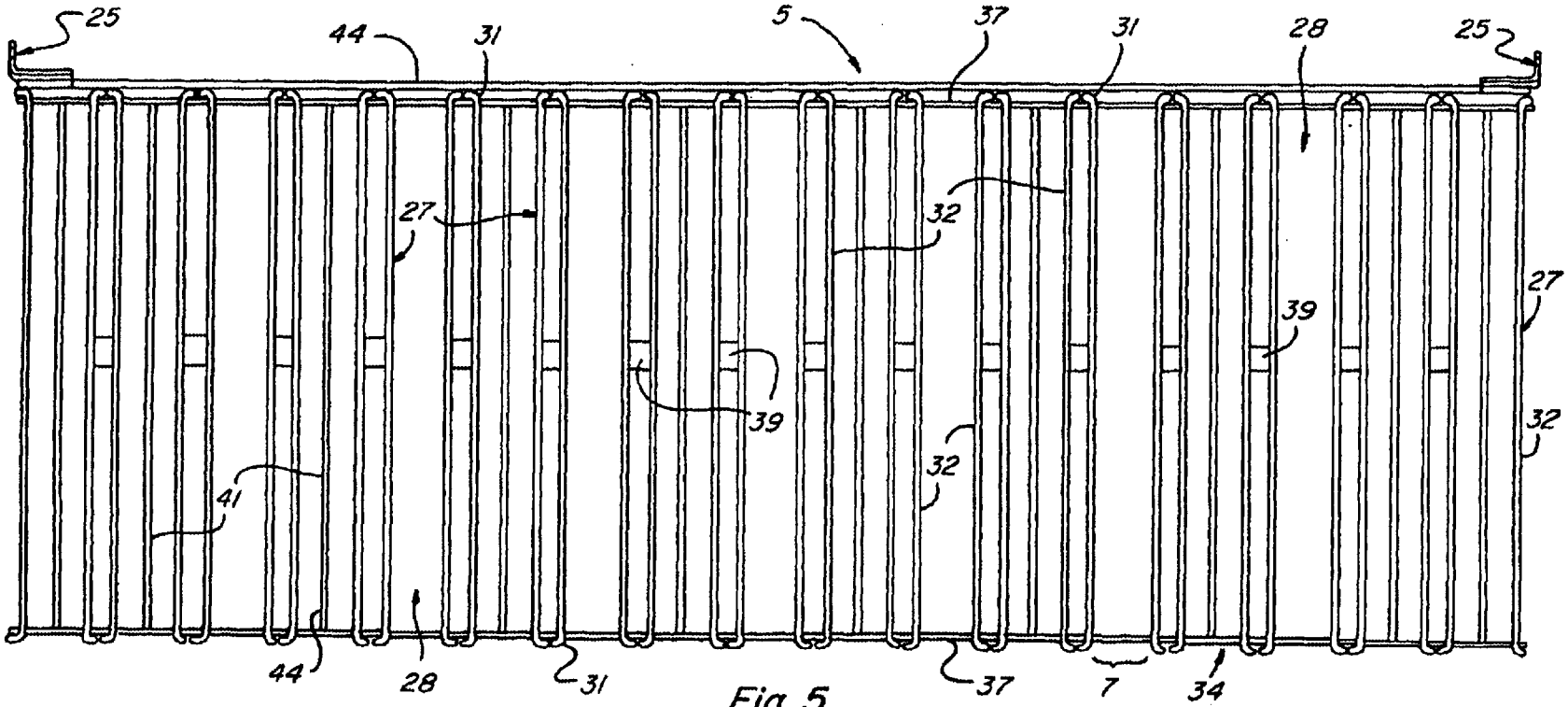
FIG. 5 is a bottom plan view of the suspension rack of FIG. 2.

A plurality of the tracks 7 associated with each rack 5 are joined together by cross wires or rod members 37 which extend transversely from side to side across both the back 33 and front 34 of the rack, the transverse members 37 being attached to the wire elements 27 forming each respective track thereby holding the respective tracks 7 in their properly spaced relationship relative to each other. As shown, the wires 37 can also be round in cross section and can be either tubular or solid. The cross wires 37 are secured to the wire elements 27 as, for example, by welding if the wires are made out of a metal material suitable for welding. For heavier products, it has been found that wire or rod members having a diameter on the order of ¼ to ⅜ of an inch in diameter are acceptable. In the illustrated structure, there are two cross wires 37 positioned at the back 33 of the rack 5 and two cross wires 37 positioned at the front 34 of the rack 5. It is recognized and anticipated that any number of cross wires 37, including a single wire or rod member 37, may be utilized adjacent the back and front portion of each rack 5 depending upon the particular application involved. Spacers or connectors 39 can also be secured to a respective straight wire portion 32 associated with adjacent tracks 7 to help strengthen and rigidify the overall structure and prevent deflection of the wire portions 32 adjacent their mid-sections. Additional bracing may be provided in the form of front to back extending wire or rod members 41 secured to one of the cross wires 37 at the front 34 and one of the cross wires 37 at the back 33 of the rack 5. Although the wire members 41 are positioned substantially in the center of certain tracks 7 as best shown in FIG. 4, it is recognized and anticipated that the wire members 41 may extend between the front and back portions of the rack 5 at any plurality of intermediate locations across its entire width. Thus, the wires 27, 37 and 41 form a box like structure when viewed from the side thereof (FIG. 3) thereby forming a cantilever beam extending between the back 33 and front 34 of the rack 5. The wires 27, 37 and 41 may be suitably coated or plated to enhance appearance and to help retard corrosion.

As can be seen in FIGS. 2–6, the sloped portions 31 of each track 7 can be used to engage, for example, a protruding ring 38 associated with the neck portion of the product container 9 to preclude its exit without first being lifted up past the sloped portions 31 to a position adjacent the pair of upstanding wire portions 29 forming each track 7 whereby the spacing between the upstanding wire portions 29 is larger than the spacing between the sloped wire portions 31. In this particular application, the sloped wire portions 31 also function as a product stop when used in a gravity feed orientation.

Figure 6:
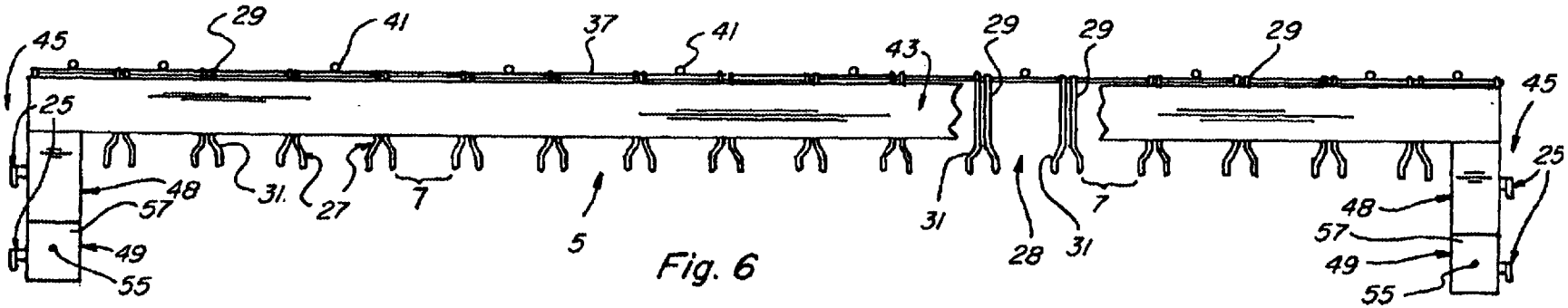
FIG. 6 is a rear elevational view of the suspension rack of FIG. 2.
Figure 7:
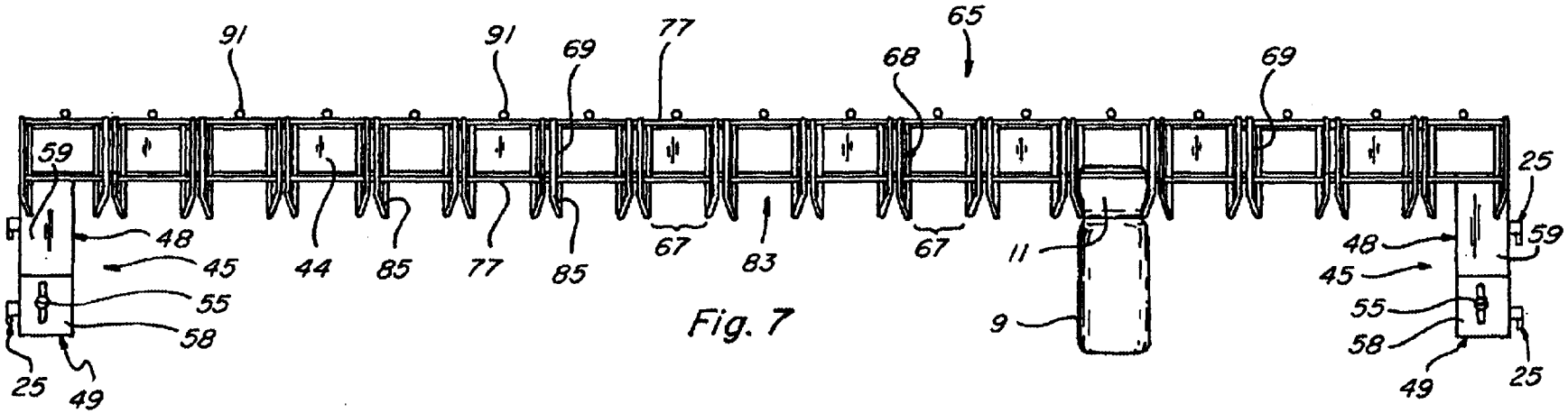
FIG. 7 is a front elevational view of another embodiment of the suspension rack illustrated in FIGS. 1–6.
Figures 12, 13, 14:
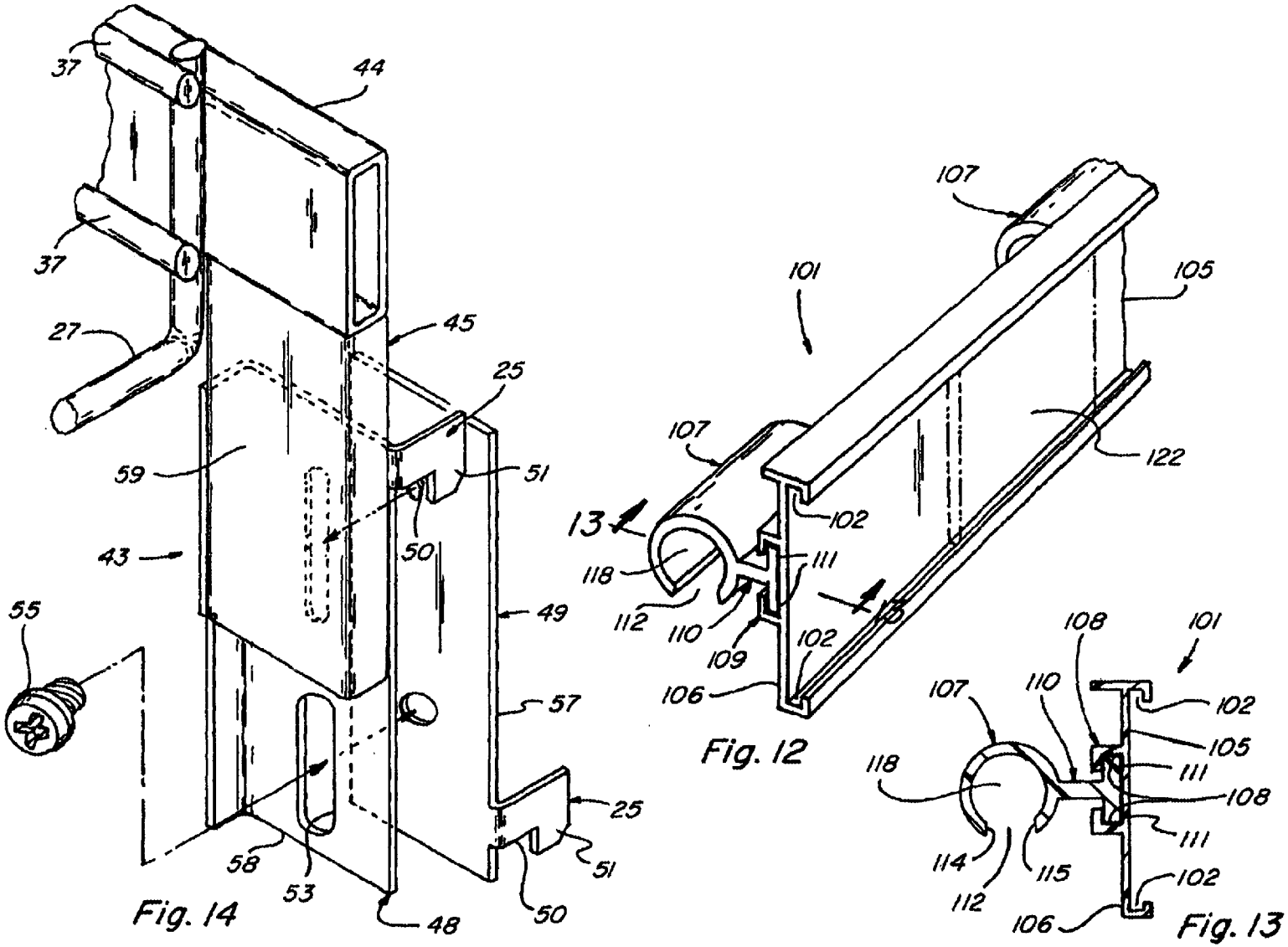
FIG. 12 is a perspective view of an informational tag rail constructed according to the teachings of the present invention.
FIG. 13 is a cross-sectional view of the tag rail of FIG. 12 taken along the line 13—13 of FIG. 12.
FIG. 14 is an expanded perspective view of a portion of the mounting structure associated with each embodiment of the present suspension rack.

The rack 5 also includes a mounting structure 43 adapted for mounting the rack 5 onto the support structure 3 as best shown in FIGS. 2, 3, 6 and 14. As illustrated in FIG. 6, the mounting structure 43 is generally U-shaped, but inverted, in construction having a cross beam 44 and two depending leg members 45. The cross beam 44 is secured to the rear upstanding wire portions 29 via any suitable attachment means such as, for example, by welding. In the illustrated structure, the depending leg members 45 each carry a pair of hook members 25 that are adjustable in their vertical spacing relative to one another. As best shown in FIG. 14, adjustment of the hook spacing on a particular leg member 45 is accomplished by the leg having a fixed component 48 and a moveable component 49 slidably mounted on the fixed component 48. Each of the two components 48 and 49 have a respective hook member 25 associated therewith, each hook member 25 including a throat portion 50 and a catch portion 51 (FIGS. 3 and 14) for receipt in a respective slot 23 associated with a support member 15, the catch portion 51 engaging the back side of the slot 23 into which it is positioned. The slots 23 in each support member 15 are dimensioned to accept the height of the hook members 25. Elongated slots 53 are provided in the fixed component 48 wherein a fastener member 55 can be used to attach the moveable component 49 to the fixed component 48 allowing selective adjustment of the spacing between the two hook members 25 on a particular leg member 45. This allows a rack 5 to be custom fitted for engagement to a particular existing display unit. The moveable component 49 includes a substantially flat plate member 57 having a hook member 25 formed thereon so as to be generally normal to the plate 57. The fixed component 48 likewise includes a formed plate member 58 having a hook member 25 formed thereon. The plate 58 is welded or otherwise attached to a member 59 which is secured to the cross beam 44. It is preferred that the respective leg members 45 and the position of the hook members 25 thereon be sufficiently close to the bottom of the rack so as to allow the rack to be positioned closely to the underside of an existing shelf associated with the overall display unit 1, and to also provide space under a particular rack 5 to both allow for suspension of the product containers 9 without interference and to allow an additional shelf or rack 5 to be mounted on the support members 15 as close as possible to the shelf or rack 5 located thereabove thereby providing efficient utilization of the vertical space within the display unit 1.

The spacing of the hook members 25 relative to one another on a particular leg member 45 can be easily adjusted by first attaching the pair of hook members 25 associated with the fixed components 48 of a particular rack 5 to the support members 15 of the support structure 3 while having the moveable components 49 loosely fitted to the respective fixed components 48 and thereafter inserting the hook members 25 associated with the moveable components 49 into corresponding slots 23 in the support members 15. The moveable hook members 25 can then be moved downwardly until the top of the throat 50 of each moveable hook member 25 engages the bottom of the slot 23 into which it is placed. The fastener 55 can then be tightened fixing the spacing between the hook members 25 on each leg member 45. When the rack 5 is empty, the top hook members 25 are sufficiently strong to hold the rack 5 in position while adjustment of the bottom hook members 25 is accomplished.

FIGS. 7–11 illustrate another embodiment 65 of the present suspension rack wherein the rack 65 is a front load only style rack while the rack 5 illustrated in FIGS. 2–6 can be loaded from either the front or the rear portion thereof as previously explained. The rack 65 includes a plurality of tracks 67 for supporting a plurality of product containers 9 in a suspended condition such as the product container 9 illustrated in FIG. 7. Similar to the tracks 7, each track 67 is comprised of a pair of formed elongated wire elements 68 similar to the wire elements 27 associated with rack 5. Each wire element 68 includes an upstanding wire portion 69 at the respective front 74 and back 73 portions of the rack 65 similar to the upstanding wire portions 29 associated with each track 27. Extending between the upstanding wire portions 69 of each wire element 68 is a substantially straight wire portion 71, the pair of wire portions 71 associated with each track 67 forming that portion of each track which is adapted to receive and support for slidable movement therealong the upper portion 11 of each product container 9. The substantially straight wire portions 71 associated with each track 67 are generally parallel to each other as illustrated and are adequately spaced to support the particular product container 9 positioned therebetween in a suspended condition. In this particular embodiment, the forwardmost end portion of each wire portion 71 associated with each track 67 is flared outwardly such as at 85 so as to increase the space between the respective wire portions 85 as compared to the spacing between the substantially parallel wire portions 71. The upstanding wire portion 69 of each wire element 68 associated with the front portion 74 of the rack 65 is then integrally formed with or otherwise attached to the forwardmost end portion of wire portion 85, each pair of wire portions 69 and 85 associated with each track 67 forming an opening or mouth 83 for the insertion and removal of the product containers 9. The outwardly flared wire portions 85 are sufficiently angled such that when the upper portion 11 of a particular product container 9 reaches the enlarged spacing between the respective wire portions 85, the elongated wire portions 71 will no longer support the upper portion 11 of the product container 9 and such product container will be allowed to exit the respective track 67. Due to the flaring of the wire portions 85, neither the front upstanding wire portions 69 associated with each track 67 or any portion of the opening or mouth 83 form a stop means for the product containers 9.

Figure 8:
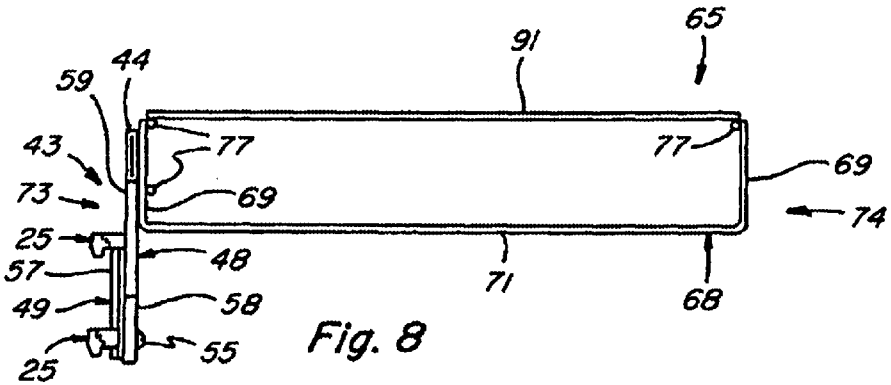
FIG. 8 is a side elevational view of the suspension rack of FIG. 7.
Figure 9:
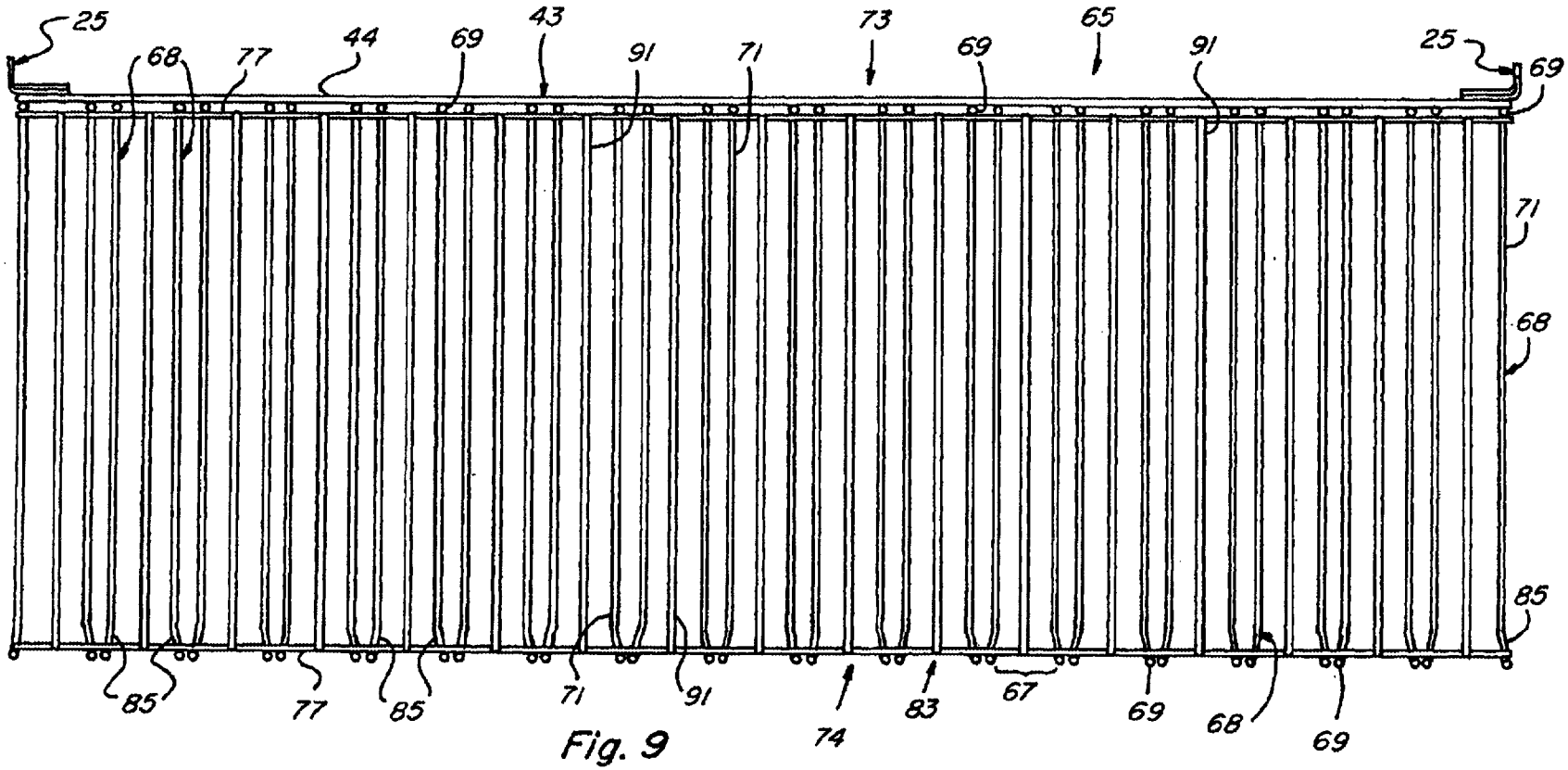
FIG. 9 is a top plan view of the suspension rack of FIG. 7.
Figure 10:
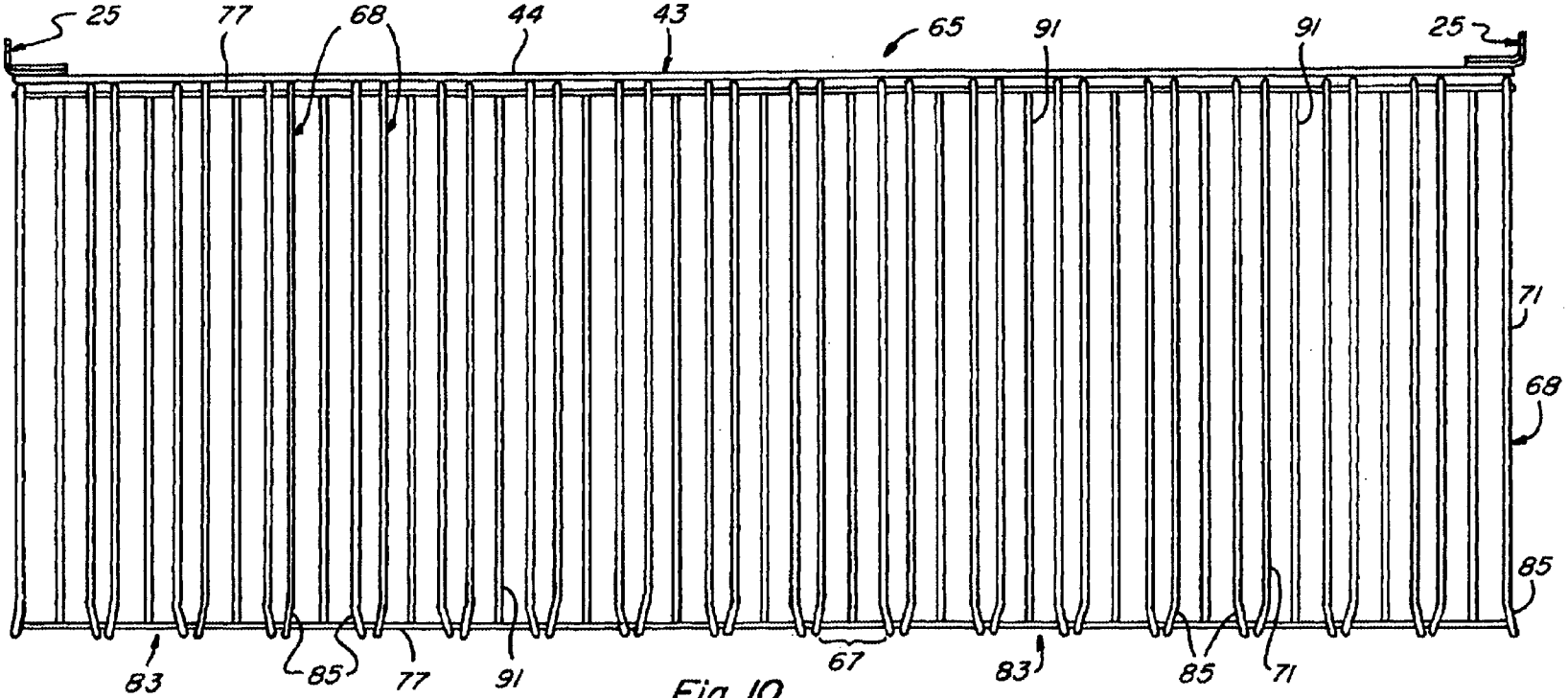
FIG. 10 is a bottom plan view of the suspension rack of FIG. 7.
Figure 11:
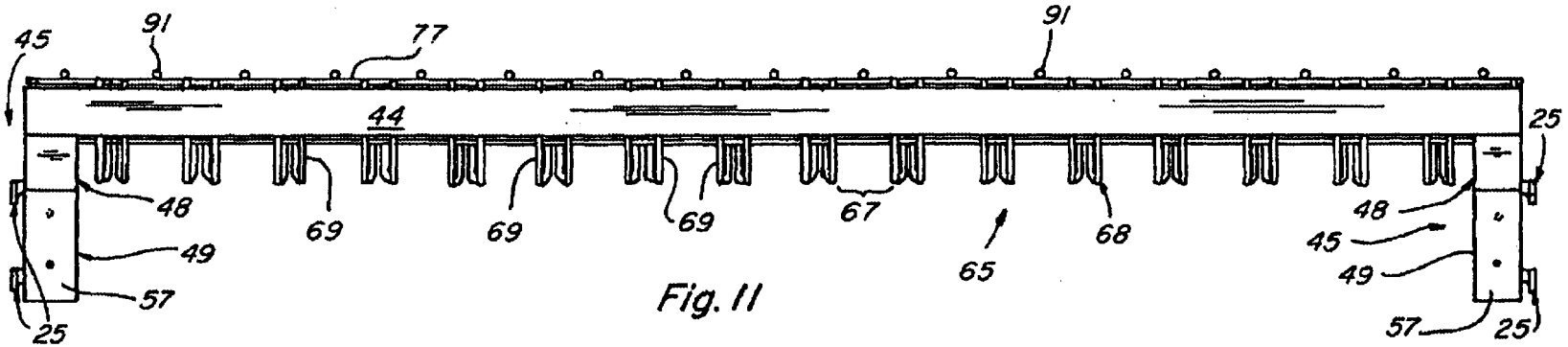
FIG. 11 is a rear elevational view of the suspension rack of FIG. 7.

In total contrast, the upstanding wire portions 69 of each wire element 68 associated with the rear portion 73 of rack 65 remains substantially straight and parallel to each other and the rearwardmost end portions of each of the substantially straight wire portions 71 associated with each track 67 likewise remain substantially straight and are not flared or angled similar to the flared portions 85 associated with the front portion of each track 67. The rearwardmost upstanding wire portions 69 are integrally formed or otherwise attached to the substantially straight rearwardmost end portions of each wire portion 71 thereby forming a stop mechanism at the rear portion of each track 67. As a result, the product containers cannot exit the respective tracks 67 from the rear of the rack 65, nor can the rack 65 be loaded with product from the rear as is true with respect to rack 5. Cross wire or rod members 77 are likewise secured to the upstanding wire portions 69 both at the front 74 and the rear 73 portions of the rack 65 to provide additional bracing and rigidity thereto. Although two wire members 67 are illustrated extending across the back portion 73 of the rack 65 and only a single wire member 77 is illustrated extending across the front portion 74 of the rack 65, it is recognized and anticipated that any number of cross members 77 may be attached to the appropriate upstanding wire portions 69 to provide sufficient rigidity to the overall structure depending upon the size and weight of the product containers 9 to be suspended therewithin. Still further, similar to the wire members 41, additional bracing may be provided in the form of wire or rod members 91 which extend from front portion to back portion of the rack 65 and are secured or otherwise attached to respective cross wire or rod members 77 as best illustrated in FIGS. 8–10. The wire members 91 are generally parallel to each other and are likewise spaced along the width of the rack 65 as previously explained with respect to wire members 41.

The same mounting structure 43 previously described with respect to rack 5 and illustrated in FIGS. 2–6 is likewise secured to the back portion 73 of the rack 65. The mounting structure 43 includes a cross beam 44, leg members 45, hook members 25, and fixed and movable components 48 and 49 respectively. The construction and operation of the mounting structure 43 including the adjustability of the hook members 25 and their engagement with respective slots 23 associated with the support members 15 are the same as previously discussed above with respect to rack 5.

As best seen in FIGS. 12 and 13, an informational tag rail or price rail 101 is provided and is adapted for use on open grid wire racks providing easy installation onto and removal from a wide variety of different wire racks. In the illustrated embodiment, the tag rail 101 includes an elongated panel member 105 having a retainer slot or groove 102 positioned adjacent each of the top and bottom edges thereof, the grooves 102 extending from the front surface of panel member 105 as best illustrated in FIG. 13. In a preferred embodiment, slots or the grooves 102 extend substantially the entire length of the panel member 105. Means are provided for detachably mounting the tag rail 101 to a wire rack such as the racks 5 and 65 as well as to still other types of wire grid racks. In the illustrated embodiment, a plurality of resiliently deformable clip members 107 extend from a back surface 106 of the tag rail 101 and are preferably removably mounted for movement along the length of the tag rail 101 so that they can be selectively positioned and thereafter clipped onto or otherwise engaged with a wire or rod member associated with the front of the rack such as the wire members 37 or 77. The clip members 107 can be engaged with an appropriate wire member 37 or 77 at any position along the length thereof without interference from the upstanding wires 29 or 69 which are secured to the cross wires 37 or 77 by merely slidably moving each clip member 107 to an appropriate location between the upstanding wires 29 or 69 as will be explained.

As best illustrated in FIG. 13, a slide channel 109 is provided on the back surface 106 of the panel member 105 and includes a pair of grooves or slots 108 facing generally toward one another and extending along the length of the tag rail 101. The clip members 107 each include a T-flange 110 with oppositely extending flange portions 111 associated therewith, the flange portions 111 being each slidably engageable with a respective groove 108 for slidable movement within the slide channel 109. The resiliently deformable clip member 107 is connected or otherwise attached to the T-flange 110 as illustrated and is generally C-shaped in cross-section having an opening 112 extending between opposite end portions 114 and 115 of clip member 107, the opening 112 providing access to the channel 118 extending through and along the length of the clip member 107. The channel 118 has a maximum transverse cross-sectional dimension that is larger than the spacing between the two opposite end portions 114 and 115 of the clip member 107 and is adaptable to receive a transverse rod or wire member associated with a particular product merchandising rack such as wire members 37 or 77. In a preferred embodiment, the clip members 107 are formed of resiliently deformable or bendable material such as plastic and can be extruded and then cut to length. The diameters of the cross wires 37 and 77 are such so as to allow the cross wire to be inserted through the opening 112 and into the channel 118 allowing the opposite end portions 114 and 115 of the clip member 107 to spread open and snap fit onto the wire member to which it is being attached. The clip members 107 can be selectively moved along slide channel 109 to avoid interference with other members associated with the front of the display rack such as wire portions 29 or 69. This arrangement enables the tag rail 101 to be releasably attached to the front portion of rack 5 or 65 and allows for its easy removal. A price tag strip member 122 or other advertising indicia may be inserted into the front grooves 102 to allow for pricing or other advertising messages to be conveyed to the consumer regarding the product containers 9 being suspended in the rack 5 or 65.

It is also recognized and anticipated that the present racks 5 and 65 can be fabricated so as to include any number of tracks such as the product tracks 7 and 67, including a single track, and that such rack devices can be easily suspended and/or connected together in side-by-side relationship to form a multiplicity of different columnar arrangements depending upon the number and width of the various product tracks needed for a particular application. In this regard, the resulting suspension racks may comprise a plurality of product modules which may be assembled in columnar array to achieve any desired width and any desired number of product tracks depending upon the particular merchandising application. Each product module can be laterally positioned and suspended in abutting side-by-side relationship to adjacent product modules so as to form an overall assembly for suspending products in a columnar array. The product modules or individual racks may also be laterally interlocked or otherwise connected together in side-by-side relationship to form a more stabilized assembly. In either case, each product module preferably includes at least one product track for suspending products positioned therewithin, it being contemplated that the respective product tracks may vary in lateral width not only to accommodate product containers of different dimensions but also due to the fact that some product modules may include more product tracks as compared to others. The construction of the various product modules as just described enables any number of such modules to be positioned adjacent each other in any preferred number to form a particular display device which not only conveniently fits in the allotted space within the existing display equipment, but also includes the maximum number of product tracks for the particular type of product containers to be merchandised therefrom. This is true whether the lateral width of each such product track is the same or of varying widths. Such product modules also provide effective means for selectively adjusting the overall width of the overall unit such as the product merchandising unit 1 illustrated in FIG. 1 to accommodate the multitude of varying sizes and different types of existing display devices including existing refrigerated display coolers, cold vaults, and other display support structures presently in use. The only limitation to the use of product modules or racks having varying numbers of product tracks associated therewith is that appropriate support members 15 must be positioned and located at the appropriate locations across the width of the overall unit in order to enable the mounting structure associated with each product module or rack to be suspended from the support structure. Regardless of the number of product tracks associated with any particular rack, each product track is constructed as disclosed and described above with respect to the product tracks 7 and 67 associated respectively with embodiments 5 and 65 of the present invention.

In addition, the overall dimensions of the present racks 5 and 65 as well as the specific shape and configuration of the various members comprising the present structures are all subject to wide variations and may be sized and shaped into a variety of different sizes and configurations so as to be compatible with the size and shape of the particular product merchandising display equipment into which the present racks 5 and 65 may be mounted, or to conform with any other space limitation, without impairing the teachings and practice of the present invention. It is also recognized and anticipated that the hook members 25 can be positioned and oriented such that the racks 5 and 65 will achieve a gravity feed inclination when the hook members 25 are engaged with the support members 15. Other variations and modifications to the various components comprising the present structures including other means for achieving a gravity feed orientation are also contemplated.

As is evident from the foregoing description, certain aspects of the present invention are not limited by the particular details of the examples illustrated herein and it is therefore contemplated that still other modifications and applications, or equivalents thereof, will occur to those skilled in the art. Other aspects, objects and advantages of the present invention can be obtained from a study of the drawings, the disclosure and the appended claims.

Thus, there has been shown and described a novel merchandising display unit and several embodiments of a suspension rack associated therewith. Many changes, modifications, variations and other uses and applications of the present constructions will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A suspension type product merchandising display unit for displaying a plurality of product containers comprising:

a support structure having at least a pair of support members associated therewith;

at least one suspension rack removably attachable to said support structure, said suspension rack including at least one track having opposed front and rear end portions for supporting in single file a plurality of product containers each having an upper portion associated therewith, each track including a pair of elongated wire elements spaced apart for receiving therebetween the upper portions of product containers such that at least a portion of the upper portion of each product container when positioned therebetween will engage at least a portion of said pair of wire elements whereby the product containers will be suspended by their upper portions for movement relative to said pair of wire elements, said suspension rack to at least some of the support members associated with said support structure;

at least the front portion of each pair of elongated wire elements forming said at least one track including an upstanding portion and a downwardly and inwardly sloped portion forming an opening at the front portion of each track for the insertion and removal of product containers, the spacing between the respective upstanding portions of each track being larger than the spacing between the respective downwardly and inwardly sloped portions of each track thereby narrowing the opening between said downwardly and inwardly sloped portions, said downwardly and inwardly sloped portions being operable to engage the upper portion of a lead product container thereby providing a stop mechanism for holding the product containers within said track, the spacing between the upstanding portions of each pair of wire elements forming said at least one track being sized so as to allow the upper portion of each product container to pass therethrough for removal from said track; and cooperatively engageable means associated with said support structure and with said mounting structure in a cantilevered fashion.

2. The suspension type product merchandising display unit defined in claim 1 wherein said cooperatively engageable means includes at least a pair of hook members associated with said support structure.

3. The suspension type product merchandising display unit defined in claim 2 wherein at least one of said hook members associated with the mounting structure of said suspension rack is adjustably moveable for engaging one of the hook receiving openings associated with one of the support members of said support structure.

4. The suspension type product merchandising display unit defined in claim 1 wherein at least the rear portion of each pair of elongated wire elements forming said at least one track includes an upstanding portion and a downwardly and inwardly sloped portion forming an opening at the rear portion of each track for the insertion and removal of the product containers, the spacing between the respective upstanding portions of each track being larger than the spacing between the respective downwardly and inwardly sloped portions of each track thereby narrowing the opening between said downwardly and inwardly sloped portions, said downwardly and inwardly sloped portions being operable to engage the upper portion of a rearwardmost product container thereby providing a stop mechanism for holding the product containers within said track, the spacing between the upstanding portions of each pair of wire elements forming said at least one track being sized so as to allow the upper portion of each product container to pass therethrough for removal from said track.

5. The suspension type product merchandising display unit defined in claim 1 wherein said mounting structure includes a member having opposite end portions and a depending leg portion associated with each opposite end thereof, each leg portion having a fixed component and a moveable component, at least said moveable component including said cooperatively engageable means for engaging at least some of the support structure, said moveable component being adjustable relative to the cooperatively engageable means associated with said support members.

6. The suspension type product merchandising display unit defined in claim 1 wherein said at least one suspension rack further includes a member extending transversely across the front of said rack, and an informational tag rail removably mountable onto said transverse member.

7. The suspension type product merchandising display unit defined in claim 6 wherein said tag rail includes a front surface and a rear surface, at least one resiliently deformable clip member extending from the rear surface of said tag rail, said at least one resiliently deformable clip member having a channel associated therewith, said channel being adaptable for receiving and engaging said transverse member.

8. A suspension type product merchandising display rack for merchandising a plurality of product containers in parallel rows, said suspension rack being adaptable for mounting to a support structure and comprising a plurality of tracks each having opposed front and rear end portions for supporting therein a plurality of product containers, each track including a pair of elongated wire elements, each elongated wire element including a substantially straight wire portion and an upstanding wire portion located at each opposite end thereof, each upstanding wire portion associated with each track further including a downwardly and inwardly sloped portion, the substantially straight wire portions associated with each track being spaced so as to receive therebetween the upper portions of product containers such that at least a portion of the upper portion of each product container engages the substantially straight wire portions of said track whereby the product containers are suspended by their upper portions for movement relative to said substantially straight wire portions, the upstanding wire portions associated with each track including the downwardly and inwardly sloped portions associated respectively therewith forming an opening at the front and rear portion of each track for inserting and removing the product containers, the spacing between the respective upstanding wire portions associated with each track being larger than the spacing between the respective downwardly and inwardly sloped portions associated respectively therewith, said downwardly and inwardly sloped portions associated with each track being operable to engage the upper portions of a product container thereby providing a stop mechanism at each end portion of each track for holding the product containers within each said track, the spacing between the upstanding wire portions associated with each track being sized so as to allow the upper portion of each product container to pass therethrough for removal from said track, and a mounting structure associated with the rear portion of said suspension rack, said mounting structure including at least a pair of hook members for attaching to the support structure, at least one of said hook members being adjustably moveable for selectively positioning said hook members for engagement with the support structure.

9. The suspension type product merchandising display rack defined in claim 8 wherein said mounting structure includes a pair of hook members located adjacent each opposite end portion thereof, at least one of said hook members located adjacent each opposite end portion of said mounting structure being adjustably moveable for selectively engaging the support structure.

10. The suspension type product merchandising display rack defined in claim 9 wherein said mounting structure includes a depending leg portion located adjacent each opposite end thereof, each leg portion including a fixed component and a moveable component, a hook member associated with each fixed and moveable component of said mounting structure, said moveable component being adjustable so as to vary the spacing between the pair of hook members associated with each leg portion.

11. The suspension type product merchandising display rack defined in claim 8 including a spacer member extending between and secured to a respective wire element associated with adjacent tracks.

12. The suspension type product merchandising display rack defined in claim 8 including at least one transverse member extending across the front portion of said rack and at least one transverse member extending across the rear portion of said rack, and a plurality of wire members extending between said front and rear transverse members at spaced locations along the width of said suspension rack.

13. The suspension type product merchandising rack defined in claim 12 including an informational tag rail removably mountable to said at least one transverse member extending across the front portion of said suspension rack.

14. The suspension type product merchandising display rack defined in claim 13 wherein said information tag rail includes an elongated panel member having front and rear surfaces and opposed end portions, a pair of grooves associated with the front surface of said panel member extending substantially along the length thereof between the opposed end portions thereof, said grooves being adaptable for receiving and releasably retaining one or more information strip members, said tag rail further including a slide channel associated with the rear surface of said panel member, and at least one clip member slidably engageable with said slide channel for slidable movement therewithin, said at least one clip member having a channel extending therethrough adaptable to receive said at least one transverse member extending across the front portion of said suspension rack and a pair of opposite end portions defining an opening therebetween accessing said channel, said at least one clip member being resiliently deformable so as to allow said at least one transverse member to pass through said opening for positioning within said channel for removably mounting the tag rail thereto.

15. The suspension type product merchandising display rack defined in claim 14 including a plurality of clip members engageable with the slide channel associated with the rear surface of said panel member.

* * * * *

UNITED STATES PATENT AND TRADEMARK OFFICE

CERTIFICATE OF CORRECTION

PATENT NO. : 6,640,983 B2
DATED : November 4, 2003
INVENTOR(S) : Donald J. Miller, Jr.

It is certified that error appears in the above-identified patent and that said Letters Patent is hereby corrected as shown below:

Title page,
Item [57], ABSTRACT,
Line 15, delete "cantilever" and replace with -- cantilevered --;

Column 11,
Line 54, after the phrase "said suspension rack", insert the phrase -- further including a mounting structure for cooperatively attaching said suspension rack --;

Column 12,
Line 9, after the phrase "cooperatively engageable means associated with", insert the phrase -- at least some of the support members associated with --;
Line 10, after the phrase "with said mounting", insert the phrase -- structure for attaching said at least one suspension rack to said support --;
Line 14, after the phrase "pair of hook members associated with", insert the phrase -- the mounting structure of said suspension rack and at least one hook receiving opening associated with at least some of the support members associated with --;
Line 48, after the phrase "at least some of the support", insert the phrase -- members associated with said support --

Signed and Sealed this

Eleventh Day of May, 2004

JON W. DUDAS
*Acting Director of the United States Patent and Trademark Office*